US005588364A

United States Patent [19]

Bolza-Schunemann

[11] Patent Number: 5,588,364

[45] Date of Patent: Dec. 31, 1996

[54] PRINT UNIT DAMAGE PREVENTION ASSEMBLY

[75] Inventor: Claus A. Bolza-Schunemann, Würzburg, Germany

[73] Assignee: Koenig & Bauer Aktiengesellschaft, Wurzburg, Germany

[21] Appl. No.: 444,363

[22] Filed: May 18, 1995

[30] Foreign Application Priority Data

May 20, 1994 [DE] Germany ..... 44 17 661.9

[51] Int. Cl.[6] ..... B41F 13/24

[52] U.S. Cl. ..... 101/247; 101/228; 101/177

[58] Field of Search ..... 101/177, 180, 101/182, 218, 216, 227, 228, 247, 143, 144, 145, 184, 219; 226/11

[56] References Cited

U.S. PATENT DOCUMENTS

| | | | |
|---|---|---|---|
| 4,369,705 | 1/1983 | Gelina | 101/177 |
| 4,523,522 | 6/1985 | Fischer | 101/219 |
| 4,838,161 | 6/1989 | Naumann et al. | 101/247 |
| 5,063,844 | 11/1991 | Fausel | 101/247 |
| 5,272,975 | 12/1993 | Dettinger et al. | 101/218 |
| 5,337,664 | 8/1994 | Hannon | 101/218 |

FOREIGN PATENT DOCUMENTS

| | | |
|---|---|---|
| 1940075 | 7/1970 | Germany . |
| 4129840 | 4/1992 | Germany . |

*Primary Examiner*—Christopher A. Bennett
*Attorney, Agent, or Firm*—Jones, Tullar & Cooper, P.C.

[57] ABSTRACT

An arrangement for preventing damage to print units, in which during a failure of the electrical supply of the web-fed rotary printing press, an energy reservoir yields its energy to control means which briefly charge adjusting means to bring at least one cylinder per print unit into a neutral pressure release position. In this way paper wrap-arounds during voltage failure no longer act in a manner damaging to the press.

8 Claims, 1 Drawing Sheet

PRINT UNIT DAMAGE PREVENTION ASSEMBLY

FIELD OF THE INVENTION

The present invention is directed generally to a print unit damage prevention assembly. More particularly, the present invention is directed to an assembly for preventing damage to print units of web-fed rotary printing presses. Most specifically, the present invention is directed to a print unit damage prevention assembly for a rotary printing press having rubber blanket cylinders which are pivotably supported in press side frames by controllable adjusting means. The positions of the rubber blanket cylinders with respect to each other and with respect to a shared or common counter-pressure cylinder are controlled by an electrically operated programmable memory control device. In the event of a power failure, the print unit damage prevention assembly operates to separate the blanket cylinders from each other and from the counter pressure cylinder.

DESCRIPTION OF THE PRIOR ART

In modern printing plants there is significant utilization of various sophisticated computer controls to set and adjust the positions of a number of printing press components. Press elements, such as rubber blanket cylinders, printing plate cylinders and numerous other cylinders and rollers are pivotably supported between the side frames of the press. Each of these pivotably supported cylinders has its own actuators that are usually hydraulic or pneumatic cylinders. These cylinders are supplied with fluid under pressure by way of electrically actuated control valves which receive their instructions from some type of programmable memory controller. If the supply of electricity should fail, the computer controlled adjustment system will no longer be operational. This may well lead to irregularities in the mechanical tension imposed by the various cylinders and rollers on the running paper web in the web-fed rotary printing press. A paper web break can readily occur before the printing press can be brought to a stop. Such a paper web break may result in a portion of the paper web becoming wrapped around one of the various blanket or plate cylinders. These paper web wrap-arounds can easily damage the printing units as well as their associated inking units.

It is apparent that a need exists for an arrangement which will prevent such press damage. The print unit damage prevention assembly in accordance with the present invention provides such an arrangement and is a significant improvement over the prior art devices.

SUMMARY OF THE INVENTION

It is an object of the present invention to provide a print unit damage prevention assembly.

Another object of the present invention is to provide an assembly for preventing damage to print units of web-fed rotary printing presses.

A further object of the present invention is to provide a print unit damage prevention assembly for a rotary printing press having rubber blanket cylinders which are pivotably supported in press side frames.

Yet another object of the present invention is to provide a print unit damage prevention assembly that is operable in case of electrical failures.

Still a further object of the present invention is to provide a print unit damage prevention assembly which will prevent paper web wrap-arounds.

As will be discussed in greater detail in the description of the preferred embodiment which is presented subsequently, the print unit damage prevention assembly in accordance with the present invention comes into operation when the electrical supply to the programmable memory controlled web-fed rotary printing press fails. In this printing press there are provided rubber blanket cylinders which are in contact with each other or with a counter pressure cylinder. These rubber blanket cylinders are pivotably supported in side frames of the press and can be moved by suitable controllable adjustment devices. An electrical energy reservoir, that can be charged during normal operation of the printing press, is connected through a suitable control assembly with the controllable adjustment devices for the blanket cylinders. In the event of a failure of the electrical supply to the programmable memory controller for the rubber blanket cylinder adjustment means, the print unit damage prevention assembly will immediately and automatically take over and will actuate the blanket cylinder adjustment means to move at least one cylinder in each print unit into a pressure release position.

The provision of an energy reservoir in the print unit damage prevention assembly insures that in the event of the failure of the usual electrical supply, that the energy will be available to briefly operate a control unit which, in turn, causes the pivotal movement of at least one of the rubber blanket cylinders in each operating print unit. The movement of the rubber blanket cylinder to a pressure off location insures that any paper web wrap-around which might occur will be harmless and will not damage the printing units, inking units or the like. The failure of the printing units electrical supply will thus render the printing unit non-operational but will not cause any damage to the printing unit.

The print unit damage prevention assembly in accordance with the present invention overcomes the limitations of the prior art. It is a substantial advance in the art.

BRIEF DESCRIPTION OF THE DRAWINGS

While the novel features of the print unit damage prevention assembly in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figures 1, 2:
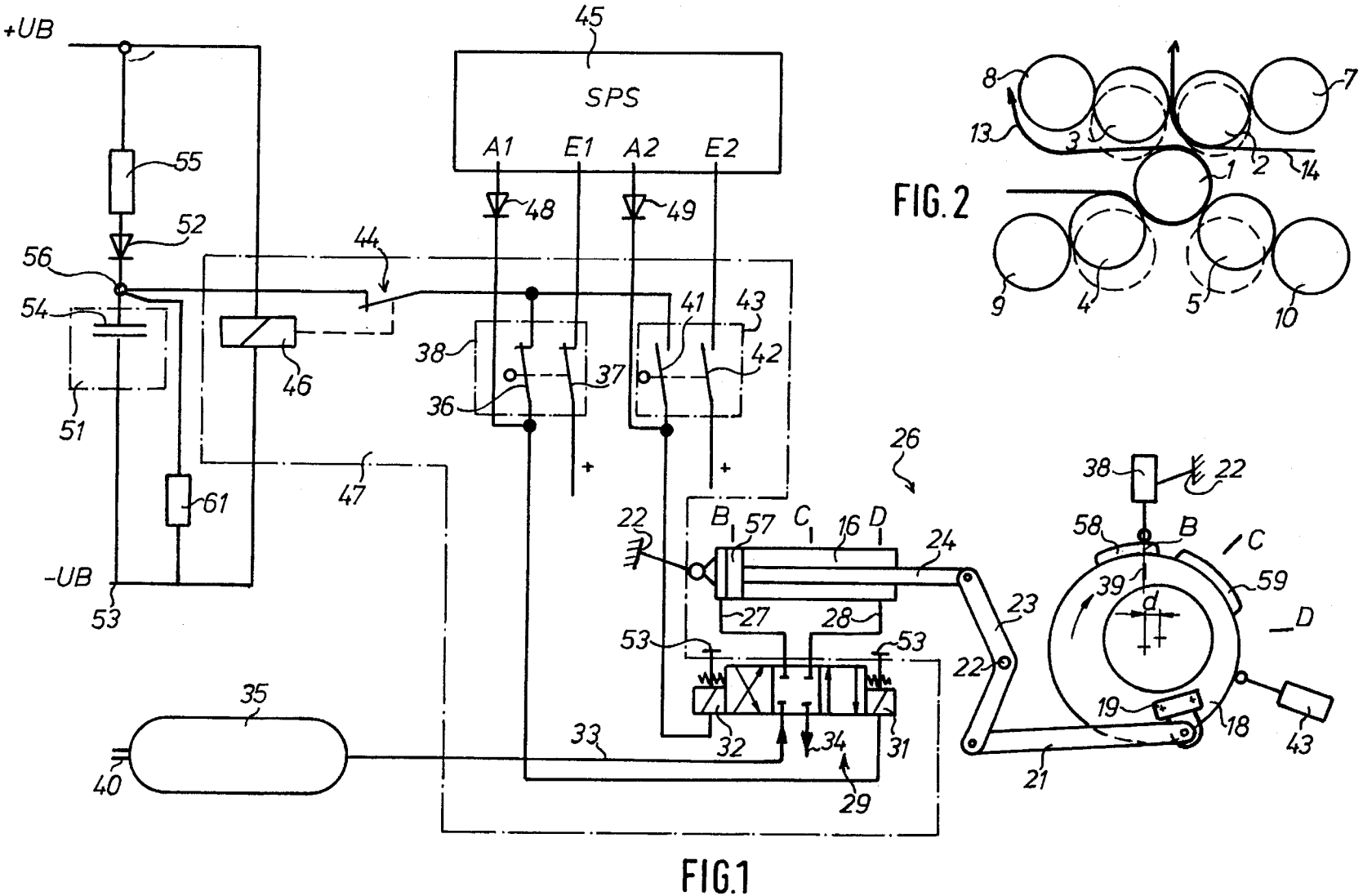
FIG. 1 is a schematic wiring and control diagram of a print unit damage prevention assembly in accordance with the present invention and showing an adjusting means and an eccentric support for a rubber blanket cylinder.
FIG. 2 is a schematic side elevation view of a satellite printing unit which is protectable from damage by the present invention.

Referring initially primarily to FIG. 2, there may be seen generally at 12 a so-called nine cylinder satellite printing unit of a web-fed rotary printing press which is to be protected from damage by the print unit damage prevention assembly in accordance with the present invention As may be seen in FIG. 4 there are provided four printing units with each of these units including a rubber covered or coated blanket cylinder 2, 3, 4 and 5; and a plate cylinder 7, 8, 9 and 10, respectively. Thus the four printing units are identified as 2,7; 3,8; 4,9 and 5,10. These four printing units are arranged generally in the shape of a cross around a central counter-pressure cylinder 1 and thus form the so-called nine-cylinder satellite print unit 12 of a web-fed rotary printing press. These four printing units can be controlled and positioned such that one or a plurality of paper webs, such as webs 13 and 14, can be fed through the satellite printing unit 12 for accomplishing printing of the paper webs 13 and 14.

The several rubber blanket cylinders 2, 3, 4 and 5 can be located or positioned so that the two blanket cylinders 2 and 3 can be in contact with each other, the two blanket cylinders 4 and 5 can be in contact with each other, or all of the rubber blanket cylinders 2, 3, 4 and 5 can be in contact with the counter-pressure cylinder 1. The several plate cylinders 7, 8, 9 and 10 are each separately assigned to a separate rubber coated blanket cylinder 2, 3, 4 or 5 respectively. Suitable inking units and, if required, damping units or systems which may be associated with the various plate cylinders 7–10 are not shown in the drawings for clarity since they form no part of the subject invention.

As is disclosed more completely in German Patent Publication DE 41 29 840 A1, whose disclosure is incorporated herein by reference, each of the rubber blanket cylinders 2, 3, 4 and 5 is disposed between side frames, such as frame 22 of the printing unit. Each rubber blanket cylinder 2–5 is separately pivotably supported in the side frames by means of suitable double acting work cylinders 16. Each of the rubber blanket cylinders can take up or be situated in at least three separate positions, as may be seen depicted schematically in FIG. 2. These three separate positions are described as follows:

Position a: The rubber blanket cylinder 2 is engaged against the adjoining rubber blanket cylinder 3. In this position, the mark 39 on an eccentric bushing 18 is situated in "pressure setting position D", Position b: The rubber blanket cylinder 4 is engaged against the adjoining rubber blanket cylinder 5. In this position, the mark 39 on an eccentric bushing 18 is situated in "pressure setting position D", Position c: The rubber blanket cylinders 2 to 5 are together engaged against the counter pressure cylinder 1. In this position, the mark 39 on an eccentric bushing 18 for each cylinder is in a "pressure setting position B", Position d: The rubber blanket cylinders 2 to 5 are each in a pressure release position, i.e. without contact with adjoining cylinders. In this position, the mark 39 on an eccentric bushing 18 for each rubber blanket cylinder is in "pressure release position C".

Pivoting of each of the rubber blanket cylinders 2 to 5 is caused to occur, as seen in FIG. 2, wherein each rubber blanket cylinder 2 to 5 has an axle arm 17 that is respectively seated in an eccentric bushing 18, which is rotatably disposed on the side frame 22. Each eccentric bushing 18 is connected by a flange 19 remote from the surface of the eccentric bushing to an adjusting means 26 by a coupling 21 as well as an angled lever 23 that is pivotably attached on the side frame 22 of the press with the end, remote from the piston 57, of a piston rod 24 of a ram cylinder 16. With its end remote from the piston rod, the ram cylinder 16 is secured on the side frame 22. The elements 16 to 24 are provided twice on each end of each blanket cylinder 2–5 and are identified, except for the side frame 22, as adjusting means 26.

The double-acting ram cylinder 16 of each adjusting means 26 is provided at its ends, with fluid connection lines 27 and 28, with each of these lines 27 and 28 being in operative connection with one throttle valve, with working connections, not indicated in detail, of a 4/3-way directional control valve 29 that has mechanical actuators 31 and 32. In its center position, the directional control valve 29 is in the blocking position. Supply and return lines 33 and 34 for the directional control valve 29 are connected with a known compressed air reservoir 35, which is connected by means of a connector 40 with a known compressed air generating device. The first magnetic actuator 31 of the directional control valve 29 is connected with opening elements 36 and 37 of a first limit switch 38, which has been attached, fixed to the press side frame, in the vicinity of the axle arm 17 of each rubber blanket cylinder 2 to 5 and whose contact actuating lever is frictionally connected with a cam 58 fixed on the surface of the eccentric bushing 18. Closing elements 41 and 42 in a second limit switch 43 are also disposed, fixed on the press side frame, in the vicinity of the axle arms 17, but at another location of the circumference of the eccentric bushing 18. Depending on the position of the rubber blanket cylinders 2–5, the contact actuating lever of the limit switch 43 is frictionally connected with the surface of the eccentric bushing 18 or with a cam 59, fixed on the eccentric bushing 18. The opening element 36 of the first limit switch 38 as well as the closing element 41 of the second limit switch 43 are connected with a first connector of an opening element 44 of a relay 46. The elements 29, 31, 32, 38, 43 may be identified generally as control means 47.

An opening element 37 of the first limit switch 38 as well as a closing element 42 of the second limit switch 43 are connected on the one side with an operating voltage UB, for example 24 V d.c., and are connected on the other side with inputs E1, E2 of a programmable memory control 45 (SPS). Outputs of the programmable memory control or SPS 45 have switched in parallel via diodes 36, 41, which prevent a reverse flow of current, with the contacts 36, 41 of the two limit switches 38, 43 in order to signal a switch position indicator of the limit switches 38, 43 for the case where the electrical current is switched on again after a failure.

The control means 47 are connected with an electric energy reservoir 51, which consists of a capacitor 54 connected with the ground 53 UB, and upstream of which capacitor 54 a diode 52 has been connected. A resistor 55 is connected upstream of the diode 52 for current limiting purpose. A protective resistance 61, of 1 kΩ for example, can be connected in parallel with the capacitor 54. The capacitance of the capacitor 54 can be 2×10 nF at 40 V. The resistor 55 connected upstream of the diode 52 can have a resistance of 1Ω. A distributing point 56 is located between the diode 52 and the capacitor 54. A connection with the second connector of the opening element 44 of the relay 46 exists from the distributing point 56, by means of which the electric energy reservoir 51 can be connected with the control means 47.

The operation of the print unit damage prevention assembly will now be discussed in detail. In addition to the motor drives, not shown, for the printing press, the rubber blanket cylinders 2 to 5 of the satellite print unit 12 are operating in a mode of operation such that the rubber blanket cylinders 2 and 3 operate against, or contact each other, and the rubber blanket cylinders 4 and 5 operate against the counter-pressure cylinder 1, as is depicted in FIG. 2. The capacitor 54, which is connected to ground, is charged during operation of the press by being connected with the operational voltage UB. The relay 46, which is connected in parallel with the energy reservoir 51, has been attracting during operation, so that the opening element 44 is opened. The control means 47 have therefore not been triggered.

When the voltage drops, so that +UB equals zero, the relay 46 drops off, the opening element 44 closes, and the energy of the capacitor 54 is discharged through the opening element 36 of the first limit switch 38, so that the magnetic actuation 31 of the directional control valve 29 is provided with a voltage from the capacitor 54 for at least a second. The space in the cylinder 16 behind the piston 57 with the piston rod 24 of the ram cylinder 16 is connected with the compressed air reservoir 35 via the directional control valve 29 and the line 27. Accordingly, the piston 57 is moved from its left end position in the direction of the right end position, because of which the rubber blanket cylinder 5 is pivoted away from the counter-pressure cylinder 1 as well as the plate cylinder 10 by an amount "d" due to the rotation of the eccentric bushing 18 of cylinder 5. Because of this, possible paper wrap-arounds are now rendered harmless with respect to the print unit comprising the counter pressure cylinder 1, the rubber blanket cylinder 5 and the plate cylinder 10 since the blanket cylinder 5 has shifted as shown in the dashed representation of the rubber blanket cylinder 2 to 5 in FIG. 2. In the process, the diode 52 prevents discharge of the capacitor 54 in the direction of positive UB 53. In the course of the movement of the piston 57 of the ram cylinder 16 from the left end position B to the center position C, the eccentric bushing 18 simultaneously turns in a clockwise direction until the cam 58, that is fixed on the eccentric bushing, has passed the contact actuating lever of the limit switch 38 and turns it off. This causes the opening element 36 to open. This process takes less than a second, so that the mark 39 on the eccentric cylinder bushing 18 is now in alignment with a mark C disposed on the side frame 22. The rubber blanket cylinder 5 therefore takes up a pressure release position as shown in dashed lines in FIG. 2.

If the rubber blanket cylinders 4 and 5 were so positioned as to touch each other during operation, as shown in connection with the rubber blanket cylinders 2, 3 in FIG. 2, the piston 57 of the ram cylinder 16 would be situated at the right end position D in the ram cylinder 16 and the mark 39 on the eccentric bushing 18 would be in alignment with the mark D applied on the side frame 22. If, in this case, the operating voltage UB fails, the opener 44 closes the relay 46, the opening elements 36 and 37 of the first limit switch 38 are opened and the closing elements 41 and 42 of the second limit switch 43 are closed. The contact actuating lever of the limit switch 43 is connected with the cam 59 and is remote from the eccentric bushing, when the piston 57 of the ram cylinder 16 is moved out of the right working position D into the pressure release position C. After the cam 59, which now rotates in a counterclockwise direction, has passed the contact actuating lever of the second limit switch 43, this second limit switch 43 is turned off, so that the closing elements 41 and 42 of second limit switch 43 open and the pressure release position C of the rubber blanket cylinder 5 has been reached as shown in the dashed line representation in FIG. 2, so that a paper wrap-around can be avoided.

It goes without saying that a separate arrangement for preventing print unit damage is required for each rubber blanket cylinder 2 to 5. This does not necessitate the provision of a great amount of additional equipment since a ram cylinder 16 for operating each rubber blanket cylinder 2 to 5 for each satellite print unit 12 must be provided anyway, as well as limit switches 38 and 43. Thus the rubber blanket cylinders 2 and 3, as shown in FIG. 2 can be pivoted in such a way that they are neither in contact with each other nor with the plate cylinders 7 or 8.

It is also possible to pivot cylinders other than the rubber blanket cylinders 2 to 5, for example such as plate cylinders, depending on the configuration of the print unit. It is furthermore possible to pivot the rubber blanket cylinders 4 and 5 into a further, third position, in which the cylinders 4 and 5 are located beyond the pressure release position 4, 1; 5, 1, as depicted in dashed lines in FIG. 2. In this further, third position, the rubber blanket cylinders 4 and 5 would then touch each other in a position analogous to the positioning of the cylinders 2 and 3 in FIG. 2.

What is claimed is:

1. A print unit damage prevention assembly usable to prevent damage to print units in a web-fed rotary printing press, said assembly comprising:

a plurality of rubber blanket cylinders pivotably supported in side frames of a printing press;

a counter-pressure cylinder supported in said side frames, said rubber blanket cylinders being selectably in contact with each other and said counter-pressure cylinder;

controllable adjustment means usable to shift said blanket cylinders in said side frames;

an energy reservoir which can receive and store electrical energy during normal operation of said printing press in which said blanket cylinders are located; and a control means interposed between said energy reservoir and said adjustment means for said blanket cylinders, said control means being operable upon a failure of an electrical supply to said printing press to provide power to said adjustment means from said energy reservoir to move at least one of said blanket cylinders to a pressure release position out of contact with its associated blanket cylinders and counter-pressure cylinder.

2. The print unit damage prevention assembly of claim 1 wherein said energy reservoir includes a capacitor connected with a source of operating voltage for each printing press and further wherein a diode is provided intermediate said capacitor and said source of operating voltage.

3. The print unit damage prevention assembly of claim 2 wherein a resistor is connected intermediate said diode and said source of operating voltage.

4. The print unit damage prevention assembly of claim 1 wherein said control means includes a relay connected in parallel with said energy reservoir to a source of operating voltage for said printing press, said control means further including an operating element and limit switches which indicate the positioned locations of said rubber blanket cylinders, said controllable adjustment means including a ram cylinder and an electromagnetically controllable directional control valve, said limit switches being in contact with said control valve.

5. The print unit damage prevention assembly of claim 4 wherein said directional control valve is a 4/3-way valve with a blocking position in a center position of said valve.

6. The print unit damage prevention assembly of claim 1 wherein said controllable adjustment means includes a double acting ram cylinder which can be charged with a pressurized fluid, said cylinder having a slidable piston and piston rod, said adjustment means further including an eccentric bushing support for each of said blanket cylinders, said eccentric bushing receiving an axle arm of said rubber blanket cylinder, said adjustment means further including a lever drive interposed between said piston rod and said eccentric bushing, said lever drive being operable to rotate said eccentric bushing in response to movement of said piston rod.

7. The print unit damage prevention assembly of claim 4 further including a programmable memory control for said adjusting means and further wherein said limit switches are connected with said programmable memory control.

8. The print unit damage prevention assembly of claim 1 wherein each of said rubber blanket cylinders is provided with its own associated energy reservoir, control means and controllable adjustment means.

* * * * *